US012576325B2

(12) United States Patent
Stamile et al.

(10) Patent No.: US 12,576,325 B2
(45) Date of Patent: Mar. 17, 2026

(54) MODIFIED KICKBOARD FLOATATION DEVICE

(71) Applicants: Emily Elizabeth Stamile, Pompano Beach, FL (US); Kelsey Lynn Stamile, Pompano Beach, FL (US)

(72) Inventors: Emily Elizabeth Stamile, Pompano Beach, FL (US); Kelsey Lynn Stamile, Pompano Beach, FL (US)

( * ) Notice: Subject to any disclaimer, the term of this patent is extended or adjusted under 35 U.S.C. 154(b) by 542 days.

(21) Appl. No.: 18/093,004

(22) Filed: Jan. 4, 2023

(65) Prior Publication Data

US 2024/0216773 A1 Jul. 4, 2024

(51) Int. Cl.
*A63B 69/14* (2006.01)

(52) U.S. Cl.
CPC ..... *A63B 69/14* (2013.01)

(58) Field of Classification Search
None
See application file for complete search history.

(56) References Cited

U.S. PATENT DOCUMENTS

| | | | | |
|---|---|---|---|---|
| 9,598,153 | B2 * | 3/2017 | Connolly | A63B 31/10 |
| 2016/0023727 | A1 * | 1/2016 | Connolly | A63B 31/10 482/111 |
| 2022/0096912 | A1 * | 3/2022 | Kummen | A63B 69/14 |
| 2025/0153027 | A1 * | 5/2025 | Kummen | A63B 69/12 |

* cited by examiner

*Primary Examiner* — Juan G Flores
(74) *Attorney, Agent, or Firm* — The Keys Law Firm PLLC

(57) ABSTRACT

A modified kickboard floatation device having a body which includes a distal portion and a proximal portion. The distal portion includes a pair of mirror image handles which are each positioned adjacent to an edge of the body and distal aperture which passes through the body. The proximal portion includes a pair of elongated longitudinal members which each extend from the distal portion in parallel with one another and are intersected by an elongated cross member. In this regard, the cross member extends both between the longitudinal members and outwardly beyond them so as to extend out from both sides of the body.

14 Claims, 3 Drawing Sheets

MODIFIED KICKBOARD FLOATATION DEVICE

BACKGROUND OF THE INVENTION

Field of the Invention

This invention relates generally to a floatation device for use while swimming and, more particularly, to an improved kickboard floatation device which is structured to optimize the support provided under the torso of a substantially prone swimmer whose body rests on the device.

Description of the Prior Art

The use of swimming floatation devices, or swimming floats, to selectively supply buoyancy in target locations and assist a user with swimming or floating in water is well established. Swimming floatation devices are commonly employed for various purposes, including to assist a user who is learning how to swim, who is engaging in therapeutic movements, or who is attempting to exercise. As a result, there exist many different types of swimming floatation devices, with the different styles often being suited to supply buoyancy to a desired area of the body and/or in a desired manner.

One well known type of swimming floatation device is a kickboard (or swimming board). Kickboards are conventionally structured as a thin, substantially rigid block having a generally rectangular shape. Kickboards of this sort are often constructed of an impermeable buoyant material, such as Ethylene-vinyl acetate foam, high-density polyethylene foam, or other foam material. Many kickboards are formed as a solid block, with no apertures, and have linear and/or curved edges. Some kickboards, however, include apertures forming hand grips in their body.

Notwithstanding minor design variations, the general structure of a kickboard allows it to be gripped by a user's hands, and held under or in front of the user's upper body. Through this positioning, kickboards can be used to supply buoyancy to or around the user's upper body and allow the user's leg kicking action to propel the swimmer in the water. This action operates to allow a user to isolate the activity of their legs and develop their leg kicking form and/or strength.

A limitation which still exists, however, is that for common kickboard designs, their substantially solid block construction often makes it difficult for a user who is learning how to swim to hold the board under their torso. Essentially, the when the solid, substantially rigid structure is placed under a user's torso, its buoyancy can be so high that together with its level of rigidity, it is difficult for the user to keep the kickboard in place under their torso and not have it fly out from under them. In addition, the conventional solid block construction also does not allow a user to hold the board and be face down on the surface of water with their mouth and nose submerged, but without the need for underwater breathing apparatus (like a snorkel or oxygen tank). As a result of these limitations, many conventional kickboard designs are difficult to use, particularly to help a beginning user learn how to properly kick.

Thus, there remains a need for a modified kickboard floatation device which is structured to optimize the support provided under the torso of a substantially prone swimmer whose torso rests on the device. It would be additionally desirable for such a modified kickboard floatation device to have a body which is flexible so as to allow a user to easily bend the upper area of the body of the modified kickboard floatation device to an angle, relative to the lower area of the body of the modified kickboard floatation device, to correspond to the curvature of the back of the user that is holding the modified kickboard floatation device. Even further, it would be desirable for such a modified kickboard floatation device to have a centrally located open area in its body which would allow a user to hold the board and be face down on the surface of water with their mouth and nose submerged.

SUMMARY OF THE INVENTION

The present disclosure provides for a floatation device, comprising: a device body having a distal portion and a proximal portion, wherein said distal portion is defined by a transverse member and said proximal portion includes a pair of elongated longitudinal members oriented in parallel with one another and which each extend from one side of the transverse member and an elongated cross member which is oriented orthogonally relative to the longitudinal members; wherein the distal portion is configured to be grasped by a user whose torso is positioned on the proximal portion; and wherein the proximal portion is configured to supply buoyancy under the torso of a user grasping the distal portion over an area which is both shorter than the length of the longitudinal members and wider than the widest part of the distal portion.

It is an object of the present disclosure to provide a modified kickboard floatation device which is structured to optimize the support provided under the torso of a substantially prone swimmer whose torso rests on the device.

It is an additional object of the present disclosure to provide a modified kickboard floatation device having a body which is flexible to allow a user who is holding the device to easily hold its upper area at an angle relative to its lower area.

It is an additional object of the present disclosure to provide a modified kickboard floatation device having a centrally located open area in its body which would allow a user to hold the board and be face down on the surface of water with their mouth and nose submerged.

DETAILED DESCRIPTION OF THE INVENTION

Figure 1:
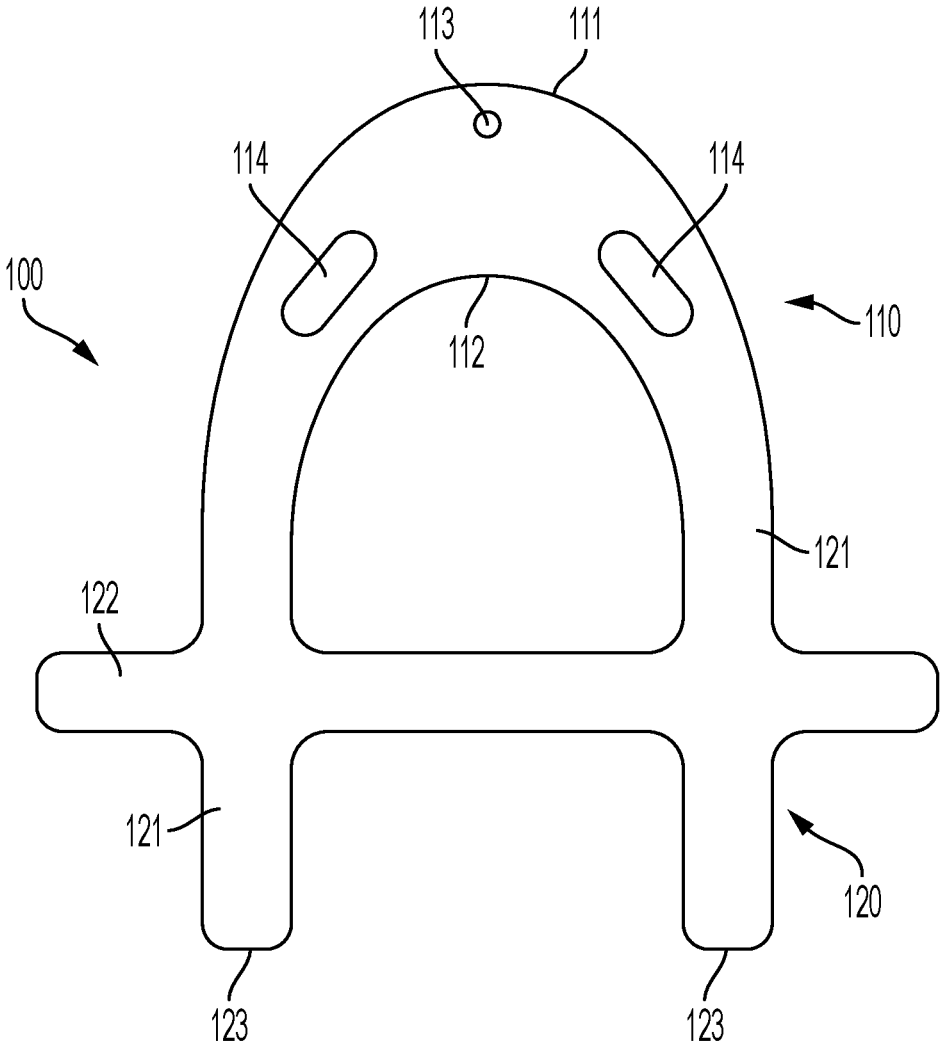
FIG. 1 is a top plan view of a modified kickboard floatation device built in accordance with the present invention.
Figure 2:
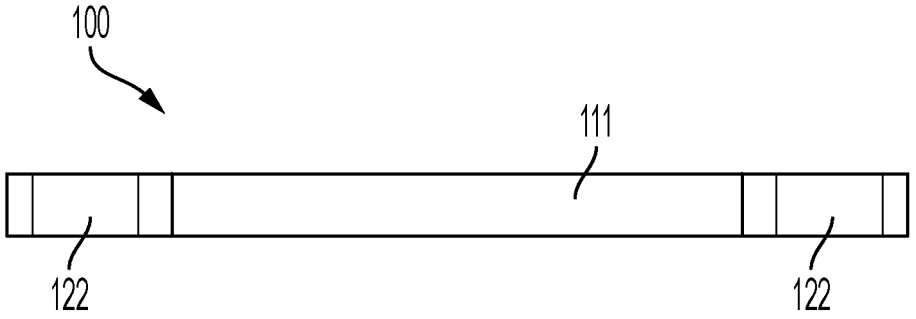
FIG. 2 is a front elevational view of a modified kickboard floatation device built in accordance with the present invention.
Figure 3:
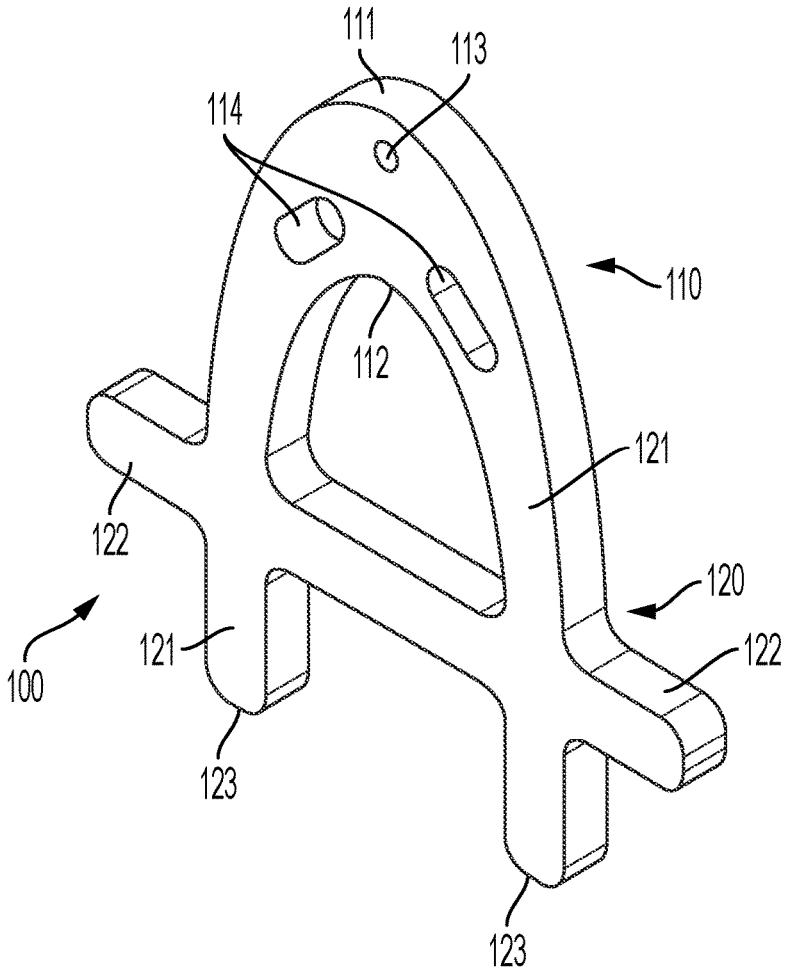
FIG. 3 is a perspective view of a modified kickboard floatation device built in accordance with the present invention.
Figure 4:
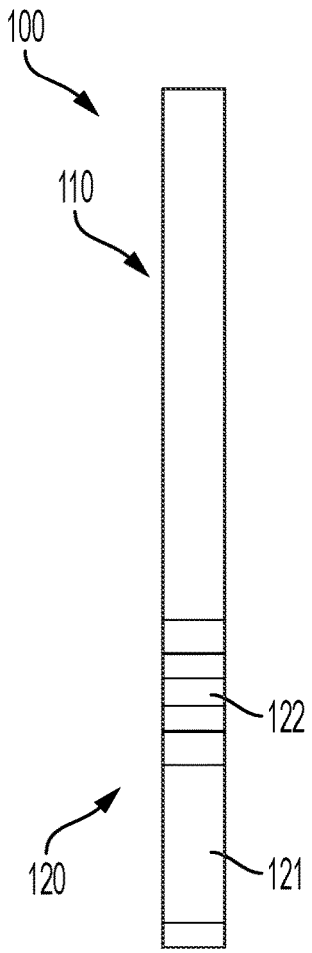
FIG. 4 is a right side elevational view of a modified kickboard floatation device built in accordance with the present invention.
Figure 5:
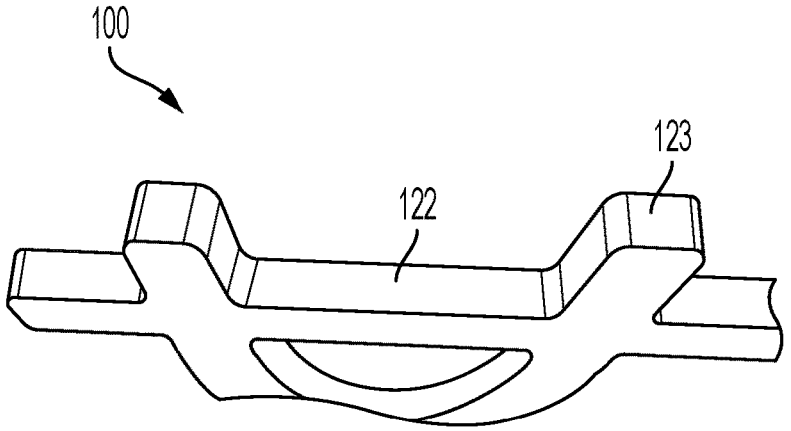
FIG. 5 is a rear perspective view of a modified kickboard floatation device built in accordance with the present invention.

Described herein is a modified kickboard floatation device having a body which includes a distal portion and a proximal portion. The distal portion includes a pair of mirror image handles which are each positioned adjacent to an edge of the body and distal aperture which passes through the body. Through the handles, the distal portion is configured to be grasped by a user whose torso is positioned on the proximal portion so as to allow the user to hold on to the modified kickboard floatation device. The proximal portion includes a pair of elongated longitudinal members which each extend from the distal portion in parallel with one another and are intersected by an elongated cross member. In this regard, the cross member extends both between the longitudinal members and outwardly beyond them so as to extend out from both sides of the body. The proximal portion, through the combination of the longitudinal members and the cross member is configured to supply a narrow band of buoyancy under the upper torso of a user holding the modified kickboard floatation device which is both shorter than the length of the longitudinal members and extends wider than the widest part of the distal portion.

Referring now to the drawings and, in particular, FIGS. 1, 2, 3, 4, and 5, a modified kickboard floatation device 100 may be defined as a device body formed from a distal portion 110 and a proximal portion 120. The device body may be made from a closed cell marine grade foam material, such as Ethylene-vinyl acetate, which is coated with vinyl (i.e., polyvinyl chloride). In this regard, the body has is constructed of a base material which resists absorption of water and this base material is further coated with a material that is waterproof. It is contemplated, however, that an alternate buoyant material and/or an alternate waterproof coating may be employed in the alternative.

The distal portion 110 is defined by a transverse member positioned between a curved distal edge 111 and a curved interior edge 112. The distal portion additionally includes a distal aperture 113 and a pair of handles 114. The handles 114 are mirror images of one another, and each may be defined by a stadium shaped aperture in the transverse member which is slanted in a manner which corresponds to the curvature of the portion of the distal edge 111 to which a given handle 114 is adjacent. The distal aperture 113 may be formed from a circular hole in the body which is positioned near an apex of the distal edge 111.

The proximal portion 120 includes a pair of elongated longitudinal members 121 and an elongated cross member 122. Each of the longitudinal members 121 extend away from the distal portion 110 at a location adjacent to one of the handles 114 in the same direction, with the longitudinal members 121 oriented in parallel to one another. The ends of the longitudinal members 121 opposite where they extend from the distal portion form the proximal ends 123 of the body. The cross member 122 is oriented orthogonally to relative to both of the longitudinal members 121 and extends from outwardly beyond of a given longitudinal member 121 on one side of the body through that given longitudinal member 121 and across to the other longitudinal member 121, through the other longitudinal member 121, and then outwardly beyond the other longitudinal member 121.

Taken together, the distal portion 110 and the longitudinal members 121 have a general (upside down) U-shape having two line parts each extending from one side of a curved part. In this context, the cross member 122 has the appearance of a straight line which extends orthogonally in between the line parts and outwardly from the line parts. The intersection of this U-shape area and the cross member 122 creates a centrally located open area in the body, with the curved interior edge 112 of the distal portion, the portion of the longitudinal members 121 above the cross member 122, and the portion of the cross member 122 between the longitudinal members 121 forming the perimeter of this centrally located open area.

Dimensionally, the general full length of the profile of the body, measured as the straight line distance between the apex of the distal edge 111 to the edge of one of the proximal ends 123 may measure 24 inches, and this measurement may be equivalent to the width of the widest part of the body, measured from one end of the cross member 122 to the other. The full width of just the U-shaped portion at its widest point, however, may be ⅝ of the widest part of the body. The width of the open area may be 10 inches at its widest point. The handles 114 may be positioned to begin 4 inches below the apex of the distal edge 111.

Figure 6:
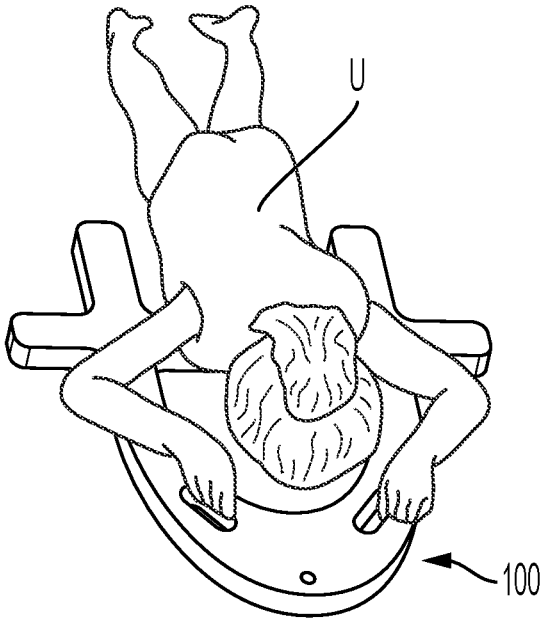
FIG. 6 is a front perspective view of a modified kickboard floatation device built in accordance with the present invention, shown with a face down user holding the device.
Figure 7:
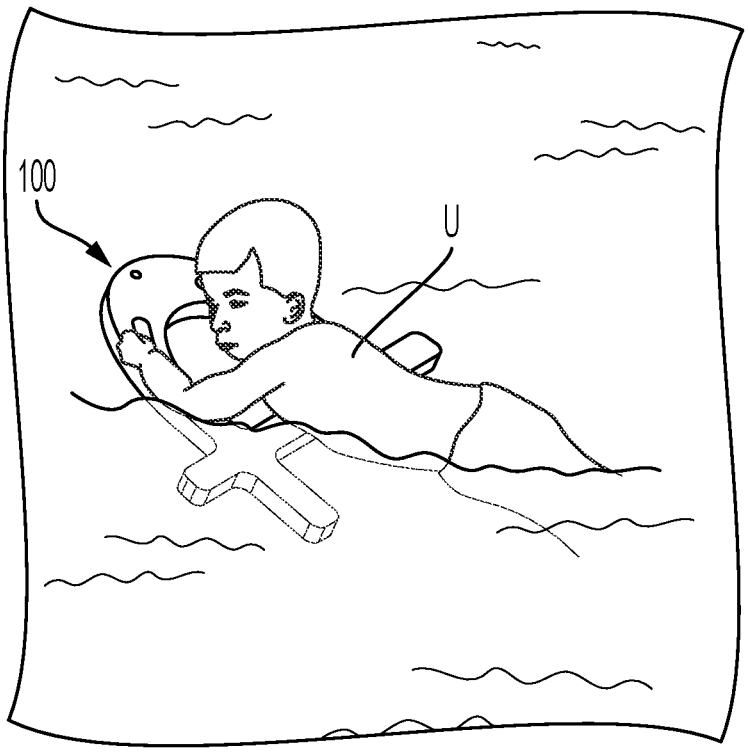
FIG. 7 is a side perspective view of a modified kickboard floatation device built in accordance with the present invention, shown with a face up user holding the device.

Referring now to FIGS. 6 and 7, a modified kickboard floatation device 100 may be used by a user U swimming in a prone position with either their face down, as illustrated in FIG. 6, or a prone position with their face up, as illustrated in FIG. 7. While in a prone position with their face down, the open area allows the user U to submerge facial features their while activating rear propulsion for movement. The purpose for this is to aid the user's U development of prone movement in a way that translates to not having a flotation aid. In this regard, the open area allows users to be face down on the surface of water with mouth and nose submerged but without the need for underwater breathing apparatus (snorkel or oxygen tank) due to the proximal buoyancy provided at the perimeter of the open area.

It is additionally appreciated that while in a prone position with their face up, a user U would be able to hold the upper area of the body of the modified kickboard floatation device to an angle.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A floatation device, comprising:

a device body having a distal portion, a proximal portion, and an open area surrounded by the distal portion and proximal portion, wherein the distal portion is defined by a transverse member and the proximal portion includes a pair of elongated longitudinal members oriented in parallel with one another and which each extend from one side of the transverse member as well as an elongated cross member which is oriented orthogonally relative to the longitudinal members;

wherein the distal portion includes a pair of handles and the distal portion is configured to be grasped by a user whose body is positioned on the proximal portion through the pair of handles; and wherein the proximal portion is configured to supply buoyancy under the body of the user grasping the distal portion over an area which is both shorter than the length of the longitudinal members and wider than the widest part of the distal portion.

2. The floatation device of claim 1, wherein the transverse member is positioned adjacent to a curved distal edge on the distal portion.

3. The floatation device of claim 2, wherein the distal portion includes a distal aperture in the device body which is positioned adjacent to an apex of the distal edge and which passes through the device body from at least one top surface to at least one bottom surface.

4. The floatation device of claim 3, wherein the distal aperture is a circular hole.

5. The floatation device of claim 1, wherein the device body is constructed of a base material that is buoyant and coated with a waterproof substance.

6. The floatation device of claim 1, wherein:

each of the handles in the pair of handles is defined by a stadium shaped aperture in the device body; and each of handles in the pair of handles are mirror images of one another.

7. The floatation device of claim 6, wherein:

the transverse member is positioned adjacent to a curved distal edge on the distal portion; and each given handle in the pair of handles is slanted in a direction which corresponds to the curvature of a portion of the distal edge to which the given handle is adjacent.

8. The floatation device of claim 1, wherein the cross member bisects each of the longitudinal members.

9. A floatation device, comprising:

a device body having a distal portion, a proximal portion, and an open area surrounded by the distal portion and proximal portion, wherein the distal portion is defined by a transverse member positioned adjacent to a curved distal edge on the distal portion and the proximal portion includes a pair of elongated longitudinal members oriented in parallel with one another and which each extend from one side of the transverse member as well as an elongated cross member which is oriented orthogonally relative to the longitudinal members;

wherein the device body is constructed of a base material that is buoyant and coated with a waterproof substance and the distal portion and the proximal portion together have a general U-shape;

wherein the distal portion includes a pair of handles and the distal portion is configured to be grasped by a user whose body is positioned on the proximal portion; and wherein the proximal portion is configured to supply buoyancy under the body of the user grasping the distal portion over an area which is both shorter than the length of the longitudinal members and wider than the widest part of the distal portion.

10. The floatation device of claim 9, wherein the distal portion includes a distal aperture defined by a circular hole in the device body, with the distal aperture being positioned adjacent to an apex of the distal edge and passing through the device body from at least one top surface in the device body to at least one bottom surface in the distal device body.

11. The floatation device of claim 9, wherein each of the handles in the pair of handles is defined by a stadium shaped aperture in the device body.

12. The floatation device of claim 11, wherein the handles in the pair of handles are mirror images of one another.

13. The floatation device of claim 12, wherein each given handle in the pair of handles is slanted in a direction which corresponds to the curvature of a portion of the distal edge to which the given handle is adjacent.

14. The floatation device of claim 9, wherein the cross member bisects each of the longitudinal members.

* * * * *